US005863128A

United States Patent [19]

Mazzei

[11] Patent Number: 5,863,128

[45] Date of Patent: Jan. 26, 1999

[54] MIXER-INJECTORS WITH TWISTING AND STRAIGHTENING VANES

[76] Inventor: Angelo L. Mazzei, 11101 Mountain View Rd., Bakersfield, Calif. 93307

[21] Appl. No.: 984,930

[22] Filed: Dec. 4, 1997

[51] Int. Cl.[6] ..... B01F 5/04

[52] U.S. Cl. ..... 366/163.2; 137/888; 137/896

[58] Field of Search ..... 366/101, 136, 366/137, 163.1, 163.2, 167.1, 173.1, 174.1, 336; 137/888, 892, 896

[56] References Cited

U.S. PATENT DOCUMENTS

| | | | |
|---|---|---|---|
| 2,361,150 | 10/1944 | Petroe | 137/888 |
| 3,799,195 | 3/1974 | Hermans | 366/163.2 |
| 4,123,800 | 10/1978 | Mazzei | 366/163.2 |
| 4,344,752 | 8/1982 | Gallagher, Jr. | 137/888 |
| 5,674,312 | 10/1997 | Mazzei | 95/261 |
| 5,743,637 | 4/1998 | Ogier | 366/163.2 |

*Primary Examiner*—Charles E. Cooley
*Attorney, Agent, or Firm*—Donald D. Mon

[57] ABSTRACT

A mixer-injector to improve the mixing and solution of treatment substances into a water stream. The mixer-injector has a constricting portion, a cylindrical injection portion, and an expanding portion in that order in the direction of flow, with an injector port entering the injection portion. The twisting vanes are formed on the wall of the constricting portion, and straightening vanes are formed on the wall of the expanding portion. The twisting vanes give a rotary component of motion to an outer portion of the water stream in the injection portion, and the straightening vanes remove at least some of it in the expanding portion, both to cause more pronounced vigorous movement of bubbles, and improved solution of the treatment substances.

8 Claims, 3 Drawing Sheets

MIXER-INJECTORS WITH TWISTING AND STRAIGHTENING VANES

FIELD OF THE INVENTION

Mixer-injectors for injecting and mixing fluids (gases and liquids) into a confined flowing water stream.

BACKGROUND OF THE INVENTION

Apparatus to inject treatment substances, which may be liquids or gases, is well-developed. One well-known device is an aspirating injector of the type shown in Mazzei patent No. 4,123,800, issued Oct. 31, 1978, which is incorporated herein by reference for its showing of injection of treatment substances into water, and an injector for doing so.

The purpose of such an injector is to bring a proportioned amount of the substance into a stream flowing through a pipe in which it is plumbed. In addition to this metering objective, it is desired to have the treatment substance well-dissolved, and distributed throughout the flowing stream of water. This is especially important when gases are introduced. The efficiency of dissolving a gas into a stream is heavily dependent on the surface area of the bubbles after the gas is injected, and of the movement of the bubbles in the stream. A vigorous movement of bubbles, and reduction in their size, will accelerate the solution of the gas. Vigorous movement also assists the distribution and solution of liquids.

This accelerated distribution of gas, and breaking its bubbles into smaller bubbles to increase the total gas liquid interface can also improve a stripping action in which one gas is entrained in the water stream for the purpose of removing a different gas from the stream. An example of this action will be found in Mazzei patent No. 5,674,312 issued Oct. 7, 1997.

Nozzles made according to the said Mazzei patent continue to perform to high standards of accuracy in metering and mixing of treatment substances into a water stream. However, it has been found that the Mazzei device can be improved so as to accelerate the solution and mixing of the treatment substances into the water stream without an appreciable sacrifice of energy. This can provide important advantages, among them a reduction in capital cost and size of the installation. Because the treatment substance—especially for gases but also for liquids—can be dissolved (gases) and mixed (both gases and liquids) more quickly, the size of the installation and its components can be reduced because there is less need for system volume downstream from the injector for completion of the solution and mixing.

It is an object of this invention to provide a more efficient mixer-injector of the general type shown in the said Mazzei patents.

BRIEF DESCRIPTION OF THE INVENTION

A mixer-injector according to this invention has a body with a flow passage therethrough. The flow passage has an entry port, an exit port, and a circularly-sectioned wall extending along a central axis between the two ports.

The wall includes an entry portion that extends from the entry port and is substantially cylindrical with a diameter. It further includes a constricting portion that is preferably frusto-conical, with a diameter which lessens as it extends away from the entry portion. It extends to an injection portion located at the smaller end of the constricting portion.

The injection portion is substantially cylindrical, extending from its intersection with the constricting portion to its intersection with an expanding portion. An injection port enters the flow passage immediately adjacent to the intersection with the constricting portion and the injection portion.

The expanding portion is preferably frusto-conical, with a diameter that increases as it extends away from the injection portion. The expanding portion extends to the exit port.

According to a feature of this invention, the constricting portion is provided with vanes that give a twist to a limited outer cylindrical region of the stream, and the expanding portion is provided with vanes to straighten out at least some of that twist. This cylindrical region passes in a twisted flow over the injection port and directly receives the treatment substance from the injector port. When this stream flow leaves the injection portion, its outer cylindrical portion en counters the straightening vanes in the expanding portion. A tumbling and shearing action occurs there, in which entrained bubbles are broken into smaller bubbles, and some fluid in that region is directed centrally toward the central axis. In addition, the vanes straighten the flow of the outer cylindrical portion. The conversion of the rotational flow to axial flow results in improved and accelerated mixing and solution of the treatment substance, of both gases and liquids.

The above and other features of this invention will be fully understood from the following detailed description and the accompanying drawings, in which:

DETAILED DESCRIPTION OF THE INVENTION

Figure 1:
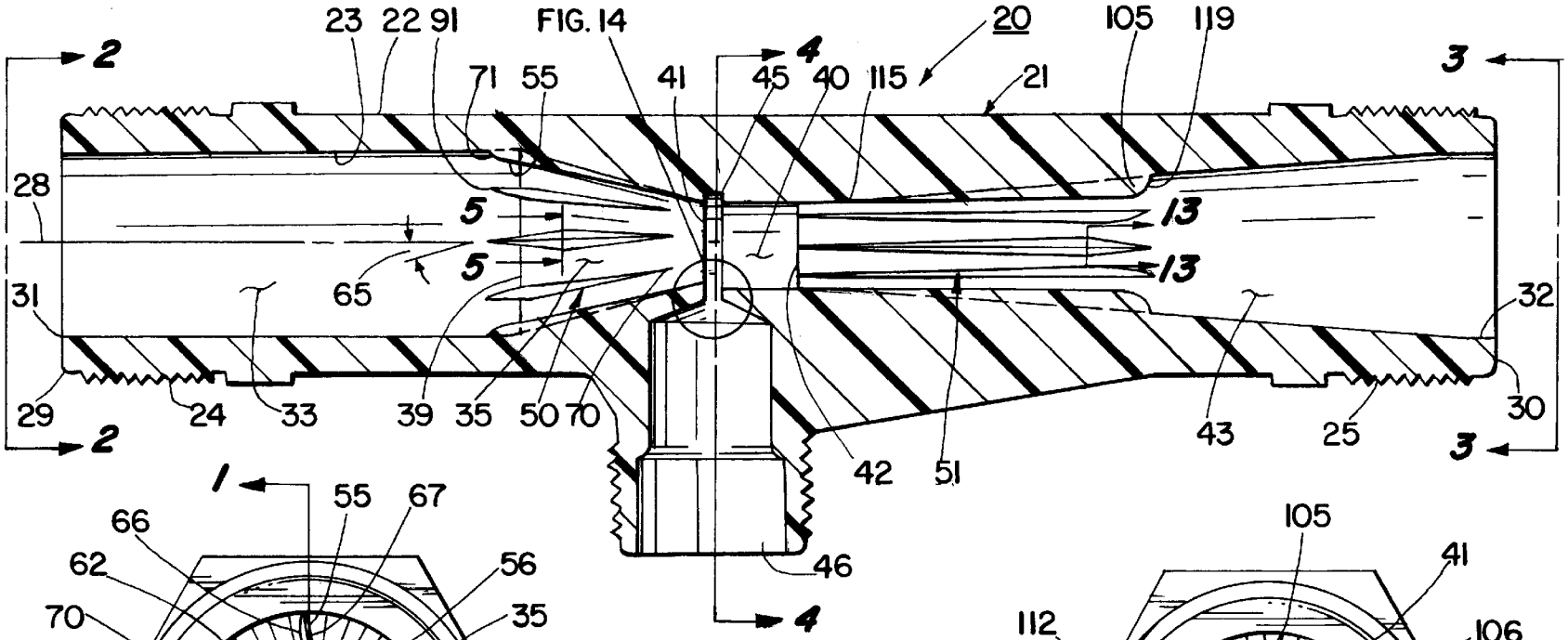
FIG. 1 is an axial cross-section of the preferred embodiment of the invention, taken at line 1—1 in FIG. 2.

The presently-preferred mixer-injector 20 of this invention is shown in cross-section in FIG. 1. It includes a body 21 having an outer wall 22 and an inner wall 23. Connector threads 24, 25 may be provided on the outer wall.

Inner wall 23 forms a flow passage 27 which extends along a central axis 28 from inlet end 29 to outlet end 30. The flow passage includes an inlet port 31 and an outlet port 32. The inner wall is circularly-sectioned.

The inner wall includes an entry portion 33, that extends from the entry port. It is substantially cylindrical, although it may have a slight taper if desired.

A constricting portion 35 extends axially from the entry portion. It is preferably frusto-conical, with a diameter which decreases as it extends away from the entry portion. The entry portion and the constricting portion meet at a circular intersection 39 which is normal to the central axis.

An injection portion 40 meets the constricting portion at a circular intersection 41 which is normal to the central axis. It is preferably cylindrical, and extends for a substantial distance to a circular intersection 42 with an expanding portion 43. Intersection 42 is also normal to the central axis.

Figure 3:
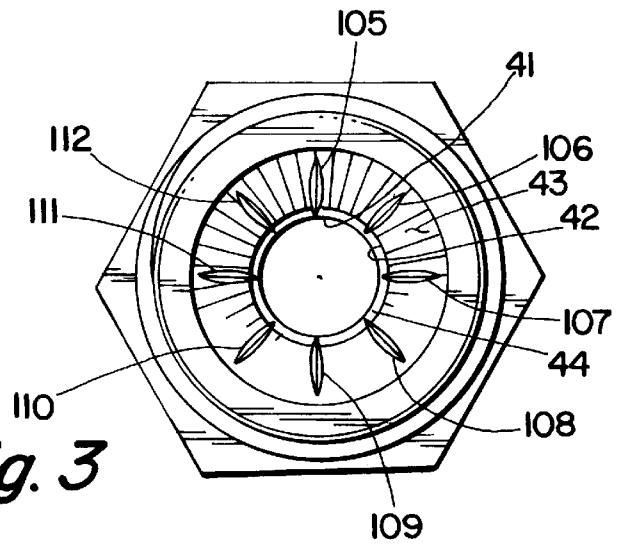
FIG. 3 is a right hand end view of FIG. 1, taken at line 3—3 therein.
Figure 2:
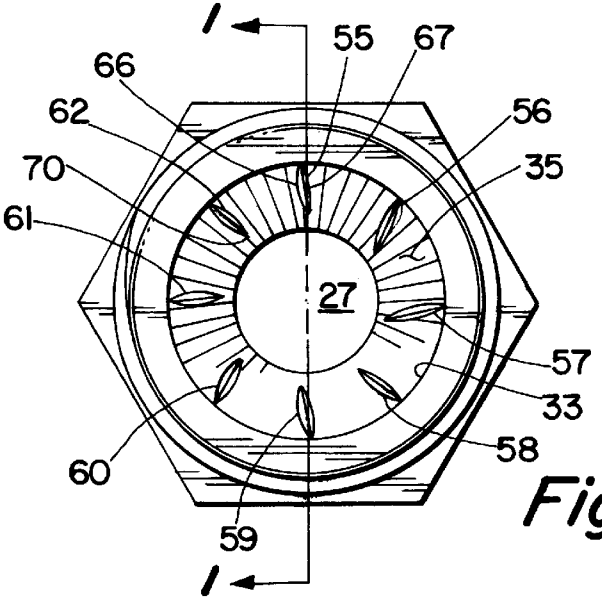
FIG. 2 is a left hand end view of FIG. 1, taken at line 2—2 therein.
Figure 4:
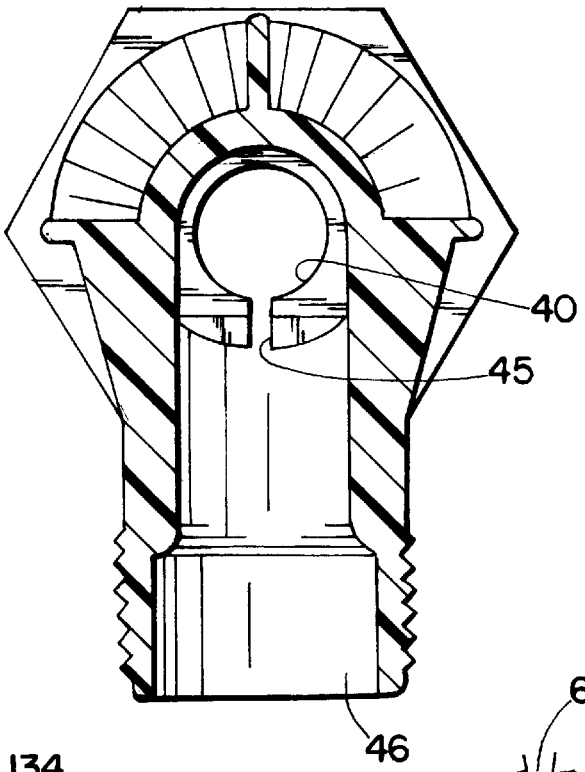
FIG. 4 is a lateral cross-section taken at line 4—4 in FIG. 1.

An injector port 45, preferably shaped as a continuous groove, is placed immediately adjacent to intersection 41. While the diameter of the injection portion may be the same as the smallest diameter of the constricting portion, there is an advantage if the diameter of the injection portion is a bit larger. The groove may be considered to be a part of the injection portion, so that there is an edge 44 (see FIG. 3) of the constricting portion that rises slightly above the diameter of the injection portion. This is an assistance in the aspiration of the substance. Instead of a continuous groove, the injector port might be a plurality of similarly-located openings. In any event conduit 46 supplies treatment substance (gas or liquid) to the injector port.

If desired, the groove may be spaced slightly from the intersection 41. In any event it should be closely adjacent to that intersection.

Expanding portion 43 is also preferably frusto-conical. It extends axially from intersection 42 to the exit port. The flow through this mixer-injector is from inlet port to outlet port. The inlet port will be connected to a pressurized flow of water. The outlet port will be connected to a user system.

The structure described to this point is essentially the mixer-injector that is shown in the said Mazzei patents. In the Mazzei patent, the flow through the flow passage as far as the injection portion is nearly plug flow. The distribution and solution of the treatment substance occurs as the consequence of such disturbances as are caused by injection of the substances and what turbulence or other internal movement of the water may occur in the injection portion. It is an object of this invention to improve the distribution and solution, but without causing such turbulence or other interferences as would significantly decrease the efficiency of the mixer-injector.

This is accomplished by a system of vanes. The first is a group 50 of twisting vanes in the entry and constricting portions, and a group 51 of straightening vanes in the expansion portion. It is not intended that the entire flow through the flow passage encounter these vanes. There is a central "core" which is radially inside of the vanes which passes between them. Only an outer tube-like "cylinder" of the flow, next to the wall, will react with these vanes. Of course the water that is redirected by these vanes and by the inward deflection caused by the constricting portion will mix and otherwise react with the core water. That is one of the objectives of this invention.

There is plurality of twisting vanes in group 50. In the illustrated example there are eight vanes 55, 56, 57, 58, 59, 60, 61 and 62. More or fewer can be provided, but eight appears to be the optimum number for the intended result. All are identical, so only vane 55 will be described in detail.

These vanes are linear, although they could be slightly curved if desired. These nozzles will usually be molded with the use of a mold cavity to form the outside wall, and a plug to form the inside wall, including the vanes. With the disclosed geometry, the plug can be pulled axially out of the entry port without rotating the plug. The vanes of group 51 are less complex.

Vane 55 is slanted at a small deflection angle 65, between about 3 to 15 degrees, but usually about 4 degrees, relative to a plane which includes the central axis, and which also passes through junction 39 where it crosses the vane. While quite small, this angularity gives a sufficient rotational component to the outer cylindrical portion of the stream for the purposes of this invention.

Figure 5:
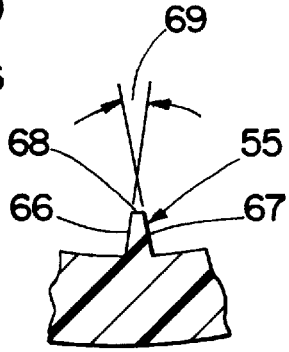
FIG. 5 is a fragmentary cross-section taken at line 5—5 in FIG. 1.

The vane is preferably formed with a wedge-like shape as shown in FIG. 5. It has a deflection face 66 facing toward the oncoming stream, and a rear face 67 facing toward junction 41. It is a convenience in molding to provide a flat surface for the crest 68 of the vane. The side faces preferably form a dihedral angle 69 between them, preferably about 20 degrees. This can vary from between about 5 degrees to about 40 degrees. This angle further facilitates the removal of the plug after the device is molded.

The vanes are aligned with one another. Each extends partway into the entry portion, and partway into the constricting portion. Their ends 70 are spaced from junction 41, and their ends 71 are spaced from the entry port. They extend across junction 39. Their crests extend at a crest angle 72 (see FIG. 9) relative to the central axis so as to rise from the entry portion, and to fair into the constricting portion. It will be noticed that the vanes do not reach the central axis. It is not intended to rotate the entire stream, but only a limited outer portion of it.

Figure 6:
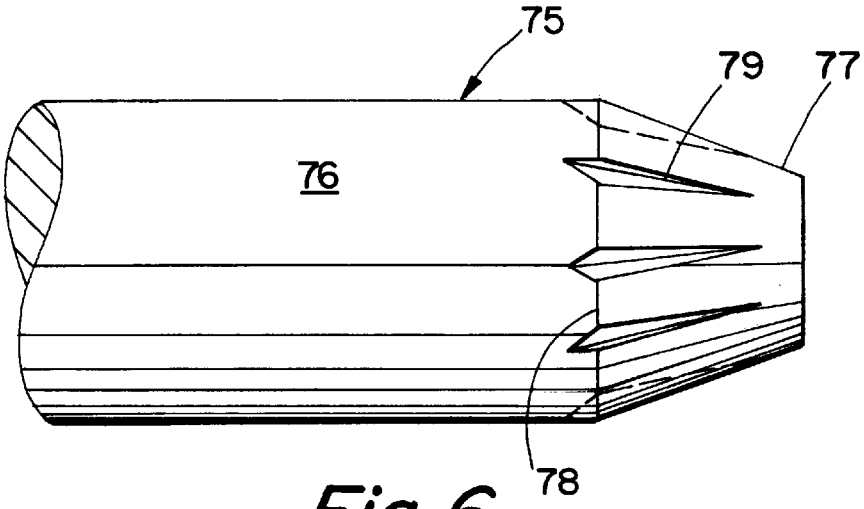
FIG. 6 is a side view of a mandrel used in molding the device of FIG. 1.

The construction of the vanes in group 50 can best be understood from an examination of the tooling plug which forms them when they are molded. FIG. 6 shows a plug 75 having an external surface 76 that forms entry portion 33, a conical portion 77 that forms the constricting portion 35, and an intersection 78 which forms junction 39.

Figure 7:
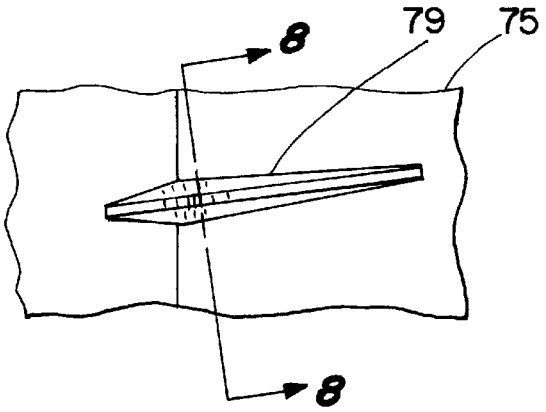
FIG. 7 is an enlarged and more detailed view of a portion of FIG. 6.
Figure 8:
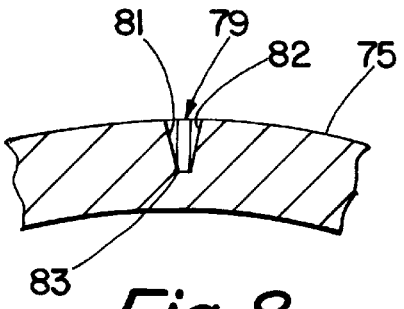
FIG. 8 is a fragmentary cross-section taken at line 8—8 in FIG. 7.

Identical slots 79 are cut into the plug as shown in FIGS. 6, 7 and 8. They are formed by a milling cutter whose cutting edge will form the slots with side faces 81, 82 and a bottom face 83, all of which are equipped to cut the metal plug. This plug will form the inner wall and the vanes when the infusion nozzle is molded.

Figure 9:
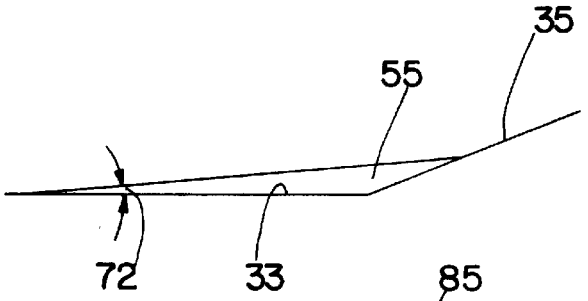
FIGS. 9–11 are schematic showings of other twisting vane profiles.
Figure 10:
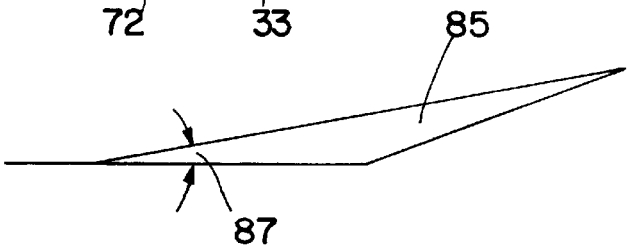
Figure 11:
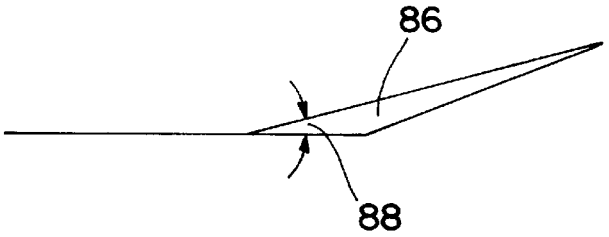

FIGS. 9, 10 and 11 schematically show vanes 55, 85 and 86 formed by cutting the slots at different angles 72, 87 and 88. These change the length, height, and excursion into the wall portions as shown. This is a convenient way to provide vanes for different diameters and flow rates. Generally the angle shown in FIGS. 1 and 11 is preferred. Its angle 88 is about 15 degrees, but it can vary between about 5 degrees and 20 degrees.

It is an advantage in the molding process to shorten the extent to which the vanes extend into the entry portion. As shown in FIG. 1, the crest of the vane 55 has a curve 91 at its upstream end. This is optional.

Figure 12:
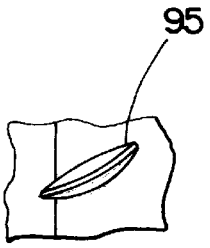
FIG. 12 is a fragmentary view showing another twisting vane configuration.

FIG. 12 shows a vane 95 in all respects like vane 55 in FIG. 1, except that it is slightly curved rather than straight, to provide additional twist to the outer part of the stream, if desired.

Group 51 of straightening vanes in the expanding portion are less complicated than those of group 50, because they are axially-directed, and are not intended to twist any part of the stream. Instead their function is to straighten the flow that had been twisted.

Figure 13:
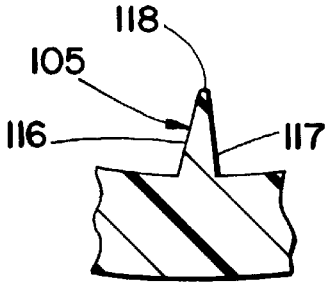
FIG. 13 is a fragmentary cross-section of a straightening vane taken at line 13—13 in FIG. 1.

Again there preferably are eight vanes, 105, 106, 107, 108, 109, 110, 111, and 112, although more or fewer could be provided. Because they are identical, only vane 105 will be described. It extends from its end 115 adjacent to junction 42 to a substantial length downstream. It has a pair of side faces 116, 117 (FIG. 13) which form a dihedral angle between them between about 2 and 30 degrees, preferably about 15 degrees. The upper, inner edge 118 may be flat or sharp, and will preferably extend about parallel to the central axis, well-spaced from it. At its end 119 it curves into the wall.

While it will usually be preferred to restrict the straightening vanes to the expanding portion for some applications and for some sizes, there are circumstances where extension of these vanes into the injection portion may be an advantage. Such an arrangement is shown in FIG. 14.

Figure 14:
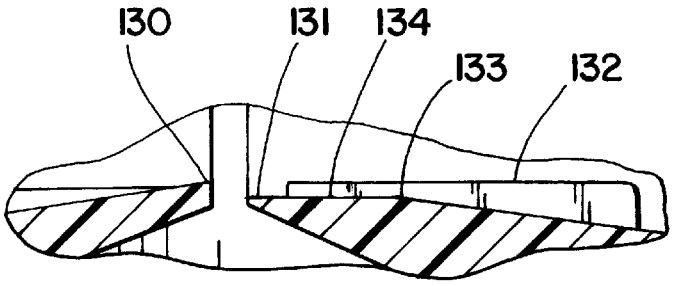
FIG. 14 is a fragmentary cross-section showing an alternate relationship between the constricting portion, the injection portion, and the straightening vanes.

In FIG. 14, junction 130, where the constricting portion and the injection portion 134 meet, the smallest diameter of the constricting portion (at junction 130) is smaller than the diameter of the injection portion 134 at edge 131 of the injector port. This is shown as a substantial "overhang" relative to the groove. Straightening vanes 132 are continued into the injection portion where they can reach into the stream, which will have been diverted farther from the wall of the injection portion than if the diameters 130 and 131 were equal, or were more nearly equal. The vanes extend axially beyond the junction 133 between the injection portion and the expanding portion, about the same proportional distance as in the other embodiments. The crests of the vanes preferably continue at the same distance from the central axis.

The plug to form these vanes and the expanding portion is uncomplicated, and obvious from the drawing of the part.

The function of this mixer injector will now be understood. The device is plumbed into a water system with the flow direction from inlet port to outlet port. A source of treatment substance perhaps air, oxygen, ozone, or chlorine if a gas, or a solution of insecticide or fertilizer if a liquid, is plumbed to the injector port. When water flows through the mixer-injector, it will draw in a proportional amount of the treatment substance, as described in the said Mazzei patents.

The outer portion of the flowing stream encounters the system 50 of twisting vanes. The outer cylindrical portion of the plug flow is given a twist by the vanes relative to the central core of the flow. It travels up the constricting portion and over the injector port. This flow, in addition to its axial and rotational velocities, has a component directed toward the central axis. This combination of motions creates a shear-like relationship with the central core after having passed over the injector port and drawn in the treatment substance, which creates an intense mixing movement in the injection portion of the substance and the water. This stream then enters the expanding portion with these three components of motion. Beyond the injection portion, in the expanding portion, it is desired to reduce the size of the bubbles and increase their numbers, whereby to increase the total interface area between gas bubbles and the water, to improve the mixing of the substance (gas or liquid) in the water, and to straighten the flow to reduce energy loss due to turbulence.

For this purpose, the outer cylindrical region, which contains a considerable proportion of any bubbles, strikes the vanes. The bubbles are broken by the vanes into smaller bubbles, thereby providing a greater interface area of gas and water. The increased area directly increases the rate of solution of the gases. In addition, the vanes direct some of the water inwardly, and also straighten that part of the stream flow.

When the additives are liquid, the same movements that break up the bubbles mix the liquids together more thoroughly.

A disciplined rotation-shear-forward tumbling action is provided by this injector-mixer that results in an average increase of about 6 to 10% in the rate of solution of gases, and an important improvement in mixing of both gases and liquids, both with a loss of energy which is barely noticeable.

A useful set of dimensions for a 2" mixer-injector is as follow in inches:

| | |
|---|---|
| Diameter of the entry portion: | 1.55 |
| Diameter of junction 41: | 0.75 |
| Diameter of Injection portion 40: | 0.79 |
| Largest diameter of expansion portion 43: | 1.55 |
| Axial width of groove 45: | 0.14 |
| Axial length of injection portion 40: | 0.655 |
| Axial length of constricting portion 35: | 1.087 |
| Axial length of expanding portion 43: | 5.660 |
| Axial length of twisting vanes 50: | 0.950 |
| Axial length of straightening vanes: | 3.05 |

This invention is not to be limited by the embodiments shown in the drawings and described in the description, which are given by way of example and not of limitation, but only in accordance with the scope of the appended claims.

I claim:

1. In a mixer injector having a body with a first and a second end, a flow passage therethrough from end to end, said flow passage being defined by a circularly sectioned wall extending along a central axis from an inlet port at said first end to an outlet port at said second end, said wall forming:

a. a substantially cylindrical entry portion;

b. a constricting portion;

c. a substantially cylindrical injection portion; and d. an expanding portion;

said constricting portion interconnecting said entry portion and said injection portion, and being substantially frusto-conical, said expanding portion joining to said injection portion, and being substantially frusto-conical, an injector port entering said injection portion through said wall immediately adjacent to the intersection of said constricting portion and injection portion, the improvement comprising:

a set of twisting vanes on said wall, each said twisting vane extending from a location in said entry portion to a location in said constricting portion, said vanes rising from said wall and having a crest forming an acute angle with a plane that includes said central axis and which passes through said twisting vanes, said crest being radially spaced from said central axis, there being a plurality of said twisting vanes angularly spaced apart from one another; and a set of straightening vanes on said wall, each said straightening vane extending along said wall in said expanding portion, said vanes being parallel to said central axis, there being a plurality of said straightening vanes angularly spaced apart from one another, said straightening vanes having a crest substantially parallel to and radially spaced from said central axis.

2. A mixer-injector according to claim 1 in which said twisting vanes terminate at a location axially spaced from the intersection of said constricting and injection portions.

3. A mixer-injector according to claim 1 in which said straightening vanes are entirely placed in the said expanding portion.

4. A mixer-injector according to claim 3 in which said twisting vanes terminate at a location axially spaced from said the intersection of said constricting and injection portions.

5. A mixer-injector according to claim 1 in which said straightening vanes extend into both said injection and expanding portions.

6. A mixer-injector according to claim 5 in which the smallest diameter of said constricting portion is smaller than the diameter of the injection portion.

7. A mixer-injector according to claim 6 in which said twisting vanes terminate at a location axially spaced from the intersection of said constricting and injection portions.

8. A mixer-injector according to claim 1 in which said injector port is a circumferential groove, an edge of said groove being substantially contiguous to the intersection of the constricting and injection portions.

* * * * *